United States Patent [19]

Seufert

[11] Patent Number: 4,508,547

[45] Date of Patent: Apr. 2, 1985

[54] ELECTROSTATIC PRECIPITATOR HAVING A SEALING COVER OR ROOF

[75] Inventor: Josef J. Seufert, Rüsselsheim, Fed. Rep. of Germany

[73] Assignee: Metallgesellschaft Aktiengesellschaft, Frankfurt am Main, Fed. Rep. of Germany

[21] Appl. No.: 500,295

[22] Filed: Jun. 2, 1983

[30] Foreign Application Priority Data

Jun. 9, 1982 [DE] Fed. Rep. of Germany ..... 3221718

[51] Int. Cl.[3] ..... B03C 3/82

[52] U.S. Cl. ..... 55/101; 55/385 F; 52/468; 52/483

[58] Field of Search ..... 55/101, 359, 385 F; 52/460, 468, 483, 764

[56] References Cited

U.S. PATENT DOCUMENTS

| | | | |
|---|---|---|---|
| 673,558 | 5/1901 | Kline | 52/483 |
| 1,674,210 | 6/1928 | Loucks | 52/483 |
| 1,683,364 | 9/1928 | Loucks | 52/483 |
| 3,835,603 | 9/1974 | Schnebel | 52/468 |
| 3,886,676 | 6/1975 | Alfonso | 52/468 |
| 4,248,610 | 2/1981 | Schminke et al. | 55/101 |

*Primary Examiner*—David L. Lacey

*Attorney, Agent, or Firm*—Karl F. Ross; Herbert Dubno

[57] ABSTRACT

Sheet metal covering elements for an electrostatic precipitator are held in place by "C" shaped metal clips which engage over flanges of the I beams on which the sheet metal elements rest. The clips are provided in interstices between spacedly juxtaposed edges of the sheets and the interstices are then closed by sealing strips which are seam-welded to the sheets.

3 Claims, 5 Drawing Figures

ELECTROSTATIC PRECIPITATOR HAVING A SEALING COVER OR ROOF

FIELD OF THE INVENTION

My present invention relates to a sealing cover or roof structure for an electrostatic precipitator and, more particularly, to improvements in the attachment of a ceiling structure above the gas flow compartments of an electrofilter, i.e. an electrostatic precipitator in which dust is removed from a gas stream.

BACKGROUND OF THE INVENTION

An electrostatic precipitator generally comprises a housing structure provided with a gas inlet and a gas outlet, a multiplicity of dust-collecting plates suspended in this housing for collecting particles of dust from the gas on these plates, means for dislodging the dust from the plates and for collecting the dislodged particles, and corona discharge electrodes which charge the dust particles to a polarity opposite that which is applied by a high-voltage source across the electrodes to the collecting plates.

Electrostatic precipitators may have sealing covers or roof structures, i.e. so called ceilings which can be composed of sheet metal (see inter alia commonly assigned U.S. Pat. No. 4,248,610 and the references therein cited).

Such sheet metal members can rest above support beams extending horizontally across the top of the housing and from which the collecting plates may be suspended. Metal strips can overlie the seams or edges of these metal sheets and can be welded to them to form a gas tight seal whereby the roof structure can be described as a sealing roof.

In electrostatic precipitators operated by a subatmospheric pressure of 10 to 50 mbars below atmospheric pressure, sealing roof structures of this type are generally satisfactory because of their structural simplicity, ease of installation and economy. However, they are not capable of withstanding even brief pressure rises which have come to be expected in the operation of such electrostatic precipitators with combustible gases.

The increasing concern for environmental protection has lead to greater use of electrostatic precipitators to recover dust particles from gases which may contain combustible components. Such gases can be standard flue gases from combustion chambers, e.g. boiler combustion chambers, metallurgical plants, chemical plants or the like, and even for product gases or byproduct gases, e.g. of metallurgical plants, which can contain combustible components.

During the operation of an electrostatic precipitator or electrofilter, it is not uncommon that a number of detonations are generated by ignition of such combustibles when concentrations thereof reach the explosive limit. Such detonations produce pressure waves which, at the sealing roof, may be manifested as pressure surges of up to 100 mbars. In the past such pressure surges have lifted off the sheet metal elements, broken the seals, and damaged the sheet metal elements. Indeed, experience with conventional constructions have shown that even at pressures of 5 mbar above atmospheric, sheet metal elements of the aforedescribed type can be lifted off. This is obviously a disadvantage since each time such a pressure surge occurs, it is necessary to repair the damaged roof structure which may involve some downtime of the electrostatic precipitator.

It should be noted that the beams on which the sheet metal elements rest are so-called I beams, i.e. generally have upper and lower flanges interconnected by vertical webs and with these beams are capable of withstanding considerable force since they function as structural supports for the collecting electrodes and to provide a supporting surface for the roof sheets which can be overlapped by them. The beams generally extend in the direction of gas flow, and have the same spacing as the arrays of collecting electrodes.

OBJECTS OF THE INVENTION

It is the principal object of the present invention to provide an improved sealing roof assembly for an electrostatic precipitator of the above described type whereby the disadvantages enumerated are obviated.

Another object of this invention is to provide a system for connecting the roof sheets to the joists or beams which is simple and economical, which permits the assembly of the roof structure in a rapid manner, and which can withstand pressure surges up to at least 100 mbar above atmospheric pressure.

Still another object of this invention is to provide an improved method of attaching the roofing sheets whereby welding to the carriers (beams or joists) or the drilling thereof to form holes for screws can be avoided, not only because of the additional costs of such operations, but because of the weakening of the support members that such operations would entail.

Still another object of the invention is to provide a roof structure for an electrofilter of the class described which facilitates inspection, disassembly and repair.

SUMMARY OF THE INVENTION

These objects and others which will become apparent hereinafter are attained in accordance with the present invention, in an electrostatic precipitator of the kind in which a plurality of transversely spaced longitudinal extending I beams are provided as carriers for the roof structure and the roof structure comprises a multiplicity of comparatively thin sheet metal plates disposed on these carriers, extending transversely thereof and separated by small gaps or interstices.

According to the invention, each bar of such sheets defining respective interstices is held onto a respective beam by a clip having a generally "C" shape and formed with a head projecting laterally from its body to either side thereof and overlying juxtaposed but spaced edges of the two sheets and the underlying flange of the carrier which is overhung by the head. The body of the clip extends between these juxtaposed edges through the interstices and reaches below the flange of the carrier to engage the underside of this flange over which the clip is forced with slight spreading of the clip so that intrinsic resilience of the metallic clip locks the two sheets of the carrier.

Such clips can be provided at each carrier or joist for each pair of spaced juxtaposed edges and when the interstices are then covered by strips which are welded to the metal sheets, the entire assembly is fully sealed and the frictional attachment of the sheets via the clips to the flanges can resist substantial pressure surges within the electrostatic precipitator.

According to a feature of the invention, the head of the clip is formed by welding a bar to the upper arm of the clip and the clips are held in place in part by spotwelding or tack-welding them to the respective sheets at the respective ends of the bar which overhang these sheets.

BRIEF DESCRIPTION OF THE DRAWING

The above and other objects, features and advantages of the present invention will become more readily apparent from the following description, reference being made to the accompanying drawing in which.

SPECIFIC DESCRIPTION

The invention can be applied to a dry-process electrostatic precipitator having a horizontal gas flow path through, a plurality of dust-collecting fields which follow one another in the direction of gas flow.

However, the invention is also applicable to any other elctrostatic precipitator structure which should have a sealing roof assembly and which should be capable of providing the assembly from sheet metal plates or sheets above carriers or joists in the form of flanged members so that these sheets lie on the flanges.

Figure 2:
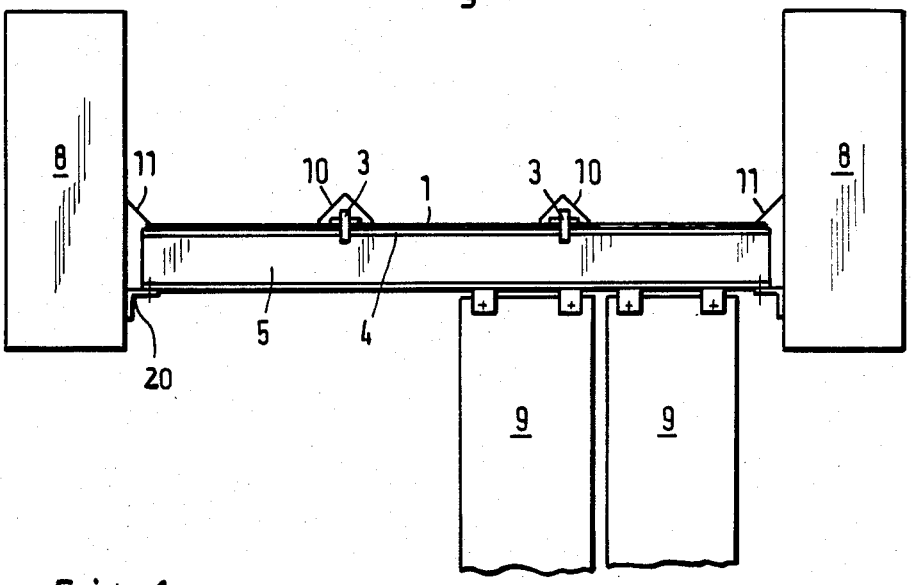
FIG. 2 is a vertical sectional view through the roof structure of FIG. 1 taken along the line II—II of FIG. 1.
Figure 1:
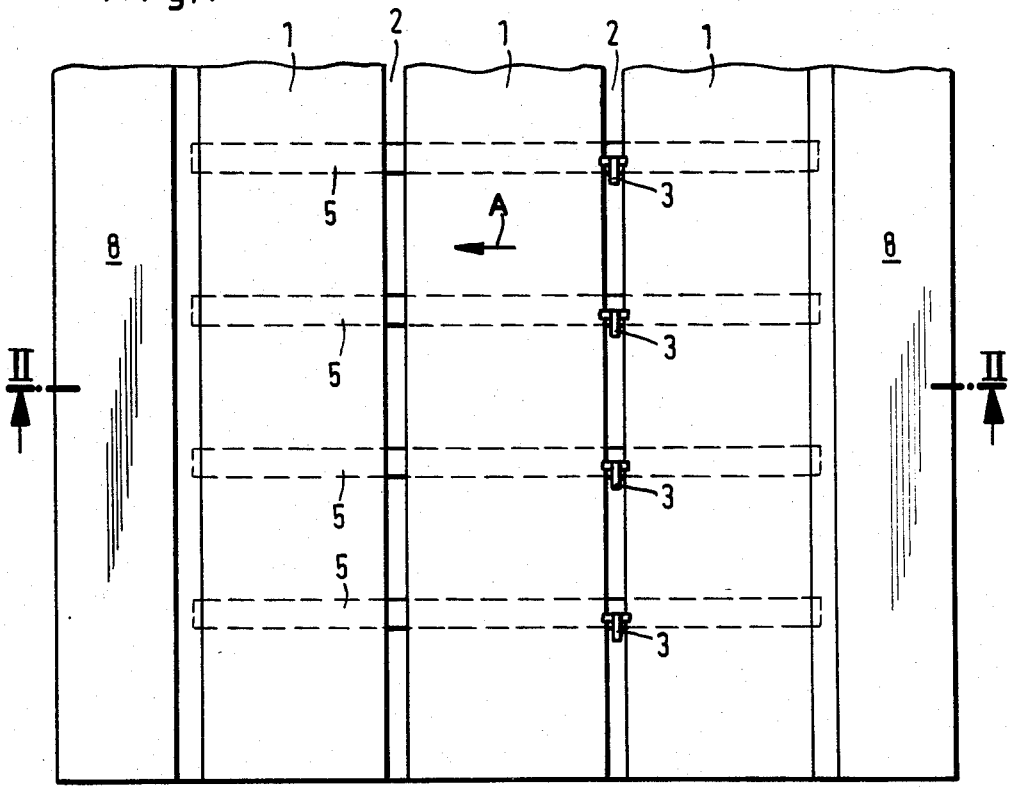
FIG. 1 is a plan view of a roof structure according to the invention prior to the application of the sealing strips diagrammatically showing some of the clips holding a pair of roof sheets on the upper flanges of a group of joists.

From FIGS. 1 and 2 it can be seen that only those elements of the electrostatic precipitator which are essential to the instant disclosure have been illustrated. In particular from FIG. 2 it can be seen that collecting electrodes can be suspended from beams or carriers 5 also referred to as joists, which extend parallel to the direction of gas flow represented by the arrow A and are supported on angle irons 20 from box-section roof beams shown at 8. The beams 5 are spaced apart essentially by the width of the gas flow passages defined by parallel arrays of the collector electrodes 9.

The beams 5 also serve as supports for the metal sheets 1 making up the ceiling structure and these sheet metal elements are initially spaced apart to define interstices 2 through which portions of the underlying beams are visible (see FIG. 1) and these interstices can then be closed by metal strips 10 and 11 which can be angled or planar and which are seam-welded to the roof beams 8 and to the sheets 1 or just to the sheets 1 over the interstices as illustrated to seal the interstices.

In accordance with the invention, each pair of sheets is held down against each beam 5 by a clip 3 passing through the interstices. The clip construction has been shown in greater detail in FIGS. 3–5.

Figure 3:
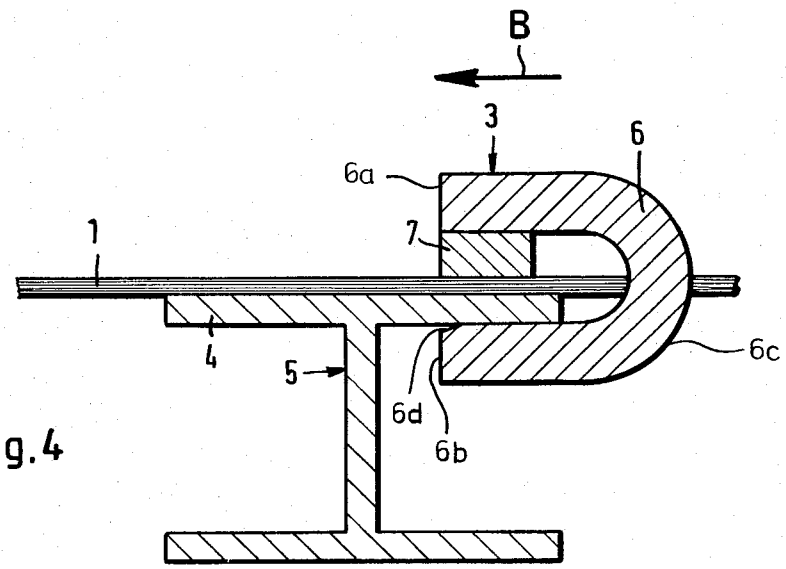
FIG. 3 is a cross sectional view taken along the line III—III of FIG. 4 and showing in some detail the clip and its relationship to one of the sheets.
Figure 4:
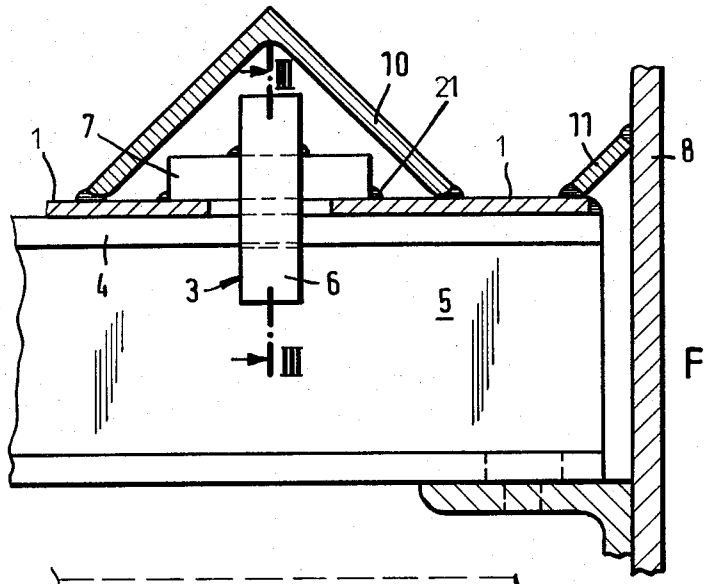
FIG. 4 is a cross sectional view corresponding to FIG. 2 but drawn to an enlarged scale and representing a detail view of a joist.
Figure 5:
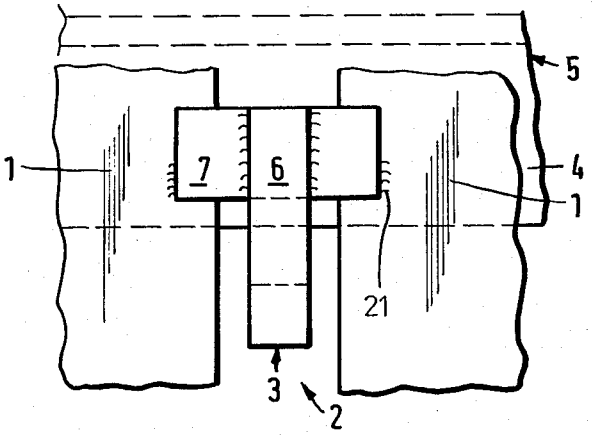
FIG. 5 is a plan view of this region of the joint prior to application of the sealing strip.

From FIGS. 3–5, it will be apparent that each clip 3 comprises a "C" shaped or "U" shaped metal body 6 which can be bent from a rectangular cross section metal bar, and has an upper arm *6a*, a lower arm *6b* and a bight *6c* connecting these arms which are designed to straddle the flange 4 of the I beam and which can be braced against the underside of the flange. A bevel *6d* can be provided to allow the clip to be fitted in the direction of arrow B over the flange and hammered into place, thereby tending to spread the arm *6a* and *6b*, slightly so that the clamping force is the intrinsic resilience or contractile force thus developed in the clip.

A transverse bar 7 is welded to the upper arm *6a* to form the head of the clip and as can be seen from FIG. 5, overlies juxtaposed but spaced apart edges of two sheets 1 where these, in turn, rest upon the underlying beam 5.

Tack-welds 21 can serve to hold the clip in place and are provided between the bar 7 and the sheets 1 (see FIG. 5) although spot-welds can equally be used.

The clips 3 can be installed and removed utilizing only a hammer in a simple manner. They have a shape which prevents them from falling through the interstices especially if the bar 7 is made somewhat wider than the width of the interstices, since it will always be of a length greater than the width of the interstices.

I claim:

1. In an electrostatic precipitator, a sealing cover assembly which comprises:

a plurality of transversely spaced mutually parallel beams extending in a gas flow direction of said precipitator and formed with upper flanges;

a plurality of sheet metal cover sheets overlying said beams and having interstices between juxtaposed edges of successive sheets extending transverse to said direction;

a multiplicity of clips for securing said sheets to said flanges, each of said clips engaging over an edge of a respective flange and having a head overlying and clamping juxtaposed edges of a respective pair of sheets against the respective flange; and strips welded to said sheets and sealing said interstices, each of said clips comprising a "C" shaped body having an upper arm formed as said head and a lower arm engaged beneath the respective flange, said body being spread slightly upon application of said flange and the respective sheets whereby said sheets are retained against said flanges by the intrinsic resiliency of said clips, each of said heads being formed by a bar welded to an upper arm of the respective body and overlying juxtaposed edges of a pair of respective sheets.

2. The electrostatic precipitator as defined in claim 1, further comprising tack-welds fixing said bars in position on the respective sheets.

3. The electrostatic precipitator as defined in claim 1 wherein the lower arm of each clip is beveled to facilitate its engagement over the respective flange.

* * * * *